US006499512B2

(12) United States Patent
Debaes

(10) Patent No.: US 6,499,512 B2
(45) Date of Patent: Dec. 31, 2002

(54) DROP PIN FOR STOP MOTION

(75) Inventor: Johnny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/020,874

(22) Filed: Dec. 19, 2001

(65) Prior Publication Data

US 2002/0079013 A1 Jun. 27, 2002

(30) Foreign Application Priority Data

Dec. 22, 2000 (BE) ..... 2000/0814

(51) Int. Cl.[7] ..... D03D 51/28
(52) U.S. Cl. ..... 139/355; 139/365; 139/353
(58) Field of Search ..... 139/355, 368, 139/353

(56) References Cited

U.S. PATENT DOCUMENTS 2,756,482 A * 7/1956 Kaufmann ..... 139/368
3,304,958 A * 2/1967 Koch ..... 139/368
5,429,157 A * 7/1995 Plemons ..... 139/353

FOREIGN PATENT DOCUMENTS

GB 407514 * 3/1934

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

Drop pin for stop motion (1) comprising a body (2) with a yarn lead-through opening (3) provided to rest on a thread extending through this opening (3). The drop pin is supported by a supporting surface or edge (4), forming a concavely curved bordering of this opening (3) and which, in cross-section, has a convex form. The supporting surface (4) may have a rounded spherical form or a form with a number of angle forming sides, such as for instance a polygon. Preferably, the yarn lead-through opening (3) is circular. Also provided is a device for detecting the thread breakage on a weaving machine, comprising a number of similar drop pins for stop motion and a weaving machine provided with a similar device.

13 Claims, 1 Drawing Sheet

DROP PIN FOR STOP MOTION

BACKGROUND OF THE INVENTION

This invention relates to a drop pin for stop motion comprising a body with a yarn lead-through opening provided to rest on a thread extending through this opening by means of a supporting edge bordering this opening.

Known drop pin for stop motion is carried out as an elongated, mainly flat metal element with a limited thickness. The drop pin has an upper part in which an elongated slot extending in the longitudinal direction of the drop pin has been provided. The drop pin has a lower part with two equally long legs which extend in the longitudinal direction of the drop pin, at a small intermediate distance, parallel to each other and which, with their extremities, form the lower end of the drop pin. The slot and the gap provided between said legs are separated from each other by a narrow intermediate strip.

The gap ends at the top in an opening that, along the top, is bordered by the flat lower edge of said intermediate strip. This opening has been provided to lead through a warp thread and is called in the patent application the yarn lead-through opening. The parts of the drop pin extending on both sides of this opening are cambered in the opposite direction perpendicular to the surface of the drop pin, so that a thread extending through this opening may extend in the plane of the drop pin.

During weaving, drop pins for stop motion are used on a weaving machine as a means of detection to detect a thread breakage. For that purpose each warp thread on the weaving machine is lead through the yarn lead-through eye of a respective drop pin for stop motion, so that the drop pin is supported by the tightened warp threads. Besides, each warp thread extends in the plane of the drop pin, so that the drop pins take up only little space as to width and the warp threads may be running very close to each other. On a weaving machine there are a great number of drop pins for stop motion next to each other in a working position, being carried by the warp threads running close together next to each other. In case a warp thread breaks, the drop pin falls down into a position where it can be detected by the detection means. This is, for instance, realized in that the drop pin in its lowered position causes an electric contact. In consequence of the detection that the warp thread has left its working position, a signal is generated, as a result of which a warning is given for instance and/or the machine is brought to a standstill automatically.

During weaving the drop pins for stop motion are kept in their positions and the warp thread is moving through the yarn lead-through opening. With the upper edge of the yarn lead-through opening, the drop pins rest on their respective warp thread and during weaving the thread moving forward is sliding over this surface. In this patent application the surface of the drop pin with which the drop pin rests on the warp thread is called the supporting edge. With these known drop pins for stop motion the supporting edge is formed by the flat lower edge of said strip. This edge forms a straight upper limitation of the yarn lead-through opening, running perpendicular to the longitudinal axis of the drop pin in the plane of the drop pin.

A drop pin for stop motion of the type described above is describes in the German Gebrauchsmuster-publication DE 299 20 333U1.

When using these drop pins for stop motion in thread breakage detection devices for weaving machines it is found that the warp threads experience a relatively strong resistance when led through the drop pins for stop motion. A fairly large number of hitches of the warp threads moving forward is also found, and this mainly when weaving with relatively thick and/or coarse yarns. These hitches cause thread breakages and/or machine stops and reduce the productivity of the weaving machine.

In GB 407.514 a drop pin for stop motion is described, the supporting edge of which, bordering the lead-through opening along the top, has a curved course in the plane of the drop pin.

Yet, with these drop pins the disadvantages mentioned above are still found.

SUMMARY OF THE INVENTION

The objective of this invention is to provide for an improved type of drop pin for stop motion, with which the above-mentioned disadvantages may be remedied or considerably reduced.

According to the invention, this objective is achieved by providing a drop pin for stop motion with the characteristics mentioned in the first paragraph of this description, said supporting edge, according to this invention, having a convex shape in cross-section.

With this, all sharp angles of the trajectory of the thread are avoided. With the known drop pins the flat or curved supporting surface in the lead-through opening forms a right angle with the two flanks of the drop pin. Thickenings, notches or protruding fibers of the warp threads are easily caught by these right angles. With the drop pin according to the invention all right or sharp angles are avoided.

In the sense of this patent application, a convex form may mean a projecting spherical form as well as a projecting form existing of several angle forming connecting sides (such as for instance a polygon). In the first situation the thread will, of course, not encounter any angles, whereas in the second situation all angles encountered by the thread during its passing the drop pin, are obtuse angles. In both cases it is found that hitches of the warp threads are considerably less frequent.

This measure has led to a particularly remarkable reduction of the disadvantages of the known drop pins described above.

Preferably, these improved drop pins for stop motion are carried out with a supporting surface forming an evenly curved bordering of the yarn lead-through opening. Because of this the risk of warp threads getting stuck is still further reduced. However, the most preferred drop pin for stop motion according to this invention has a supporting surface that forms a mainly circular bordering of the yarn lead-through opening.

The form of the supporting surface seen in a cross-section may be a rounded spherical form as well as a form with a number of angle forming sides, such as for instance the form of a polygon. The advantageous effect of this embodiment has been indicated above in this description.

It is best, to carry out the edge, bordering the yarn lead-through opening, over almost its entire length as the supporting surface. This means that almost the entire bordering of the lead-through opening is curved concavely, and the cross-section of which shows a convex form such as described above for the supporting edge. Preferably, this entire bordering of the yarn lead-through opening is circular.

Ideally, this drop pin is also carried out in such a way, that the parts of the drop pin for stop motion, bordering the yarn lead-through opening on both sides of the longitudinal axis of the drop pin, are removed from each other in a direction perpendicular to the surface of the drop pin, so that a thread extending through the yarn lead-through opening may extend in the plane of the drop pin for stop motion.

Also a device for detecting thread breakages on a weaving machine, comprising a number of drop pins for stop motion according to this invention, as well as a weaving machine provided with a similar device are within the scope of this invention.

In the following description a preferred embodiment of a drop pin for stop motion according to the invention is described in more details. The only purpose of this description is to further clarify the invention. Consequently nothing in this description may be considered as being a ground for a limiting interpretation of the scope of protection defined in the claims. In this description reference is made to the attached figures, where

DETAILED DESCRIPTION OF THE PREFERRED EMBODIMENTS

Figure 1:
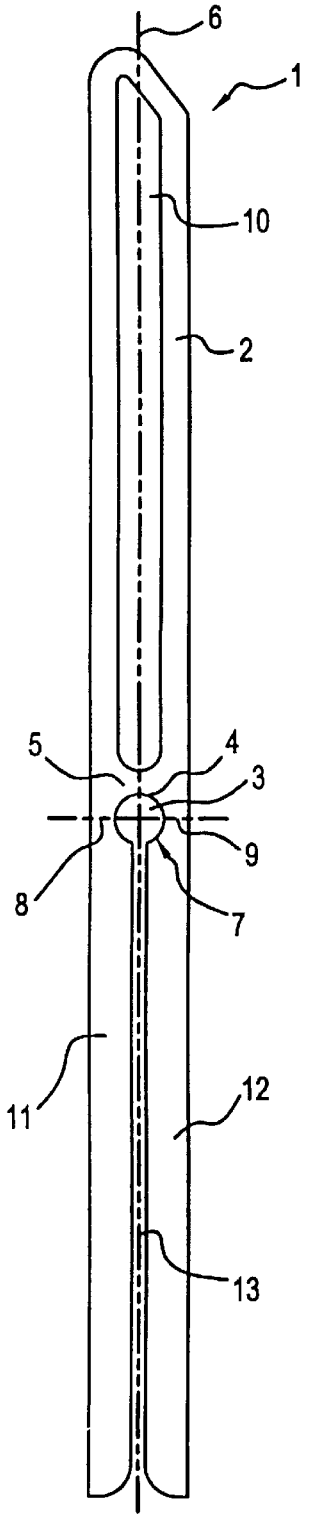
FIGS. 1 and 3 show a front view and a side view respectively of a drop pin for stop motion according to this invention.
Figure 3:
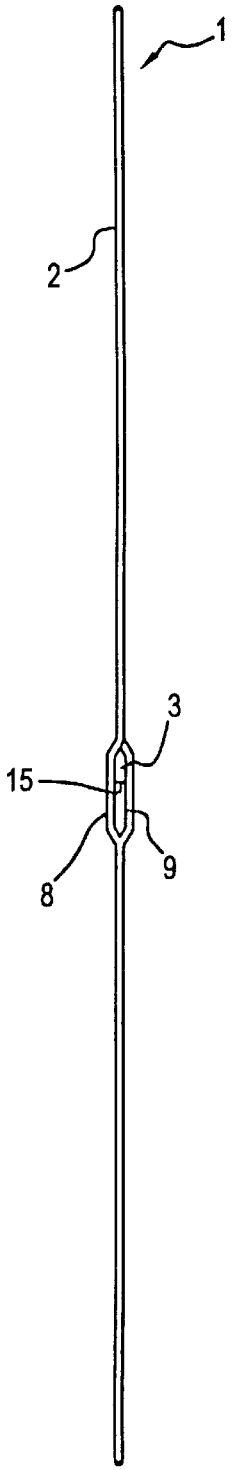

The drop pin for stop motion (1), represented in FIGS. 1 and 3, is made in one piece as a narrow, elongated metal plate-shaped body (2) with a limited thickness. The thickness is of the order of about 1 mm. This body (2) has an upper part, taking up about half the height and in which an elongated slot (10) is provided, extending in the longitudinal direction of the drop pin. Connecting to that, the drop pin has a lower part with two equally long legs (11), (12) which extend parallel to each other and symmetrically with respect to the longitudinal axis (6) on both sides of this longitudinal axis (6), and which form the lower end of the drop pin. Between said legs (11), (12) a narrow gap (13) is provided. The elongated slot (11) mentioned above and the narrow gap (13) are separated from each other by an intermediate part (5) of the plate-shaped body (2). The slot (13) ends at the top in a circular yarn lead-through opening (3).

The edge (7) of this opening (3) has an upper part, called the supporting edge (4), which is provided to rest on a warp thread led through the opening (3) when using the drop pin (1). Because this supporting edge (4) is circular, the risk of a warp thread moving over this supporting edge (4) to get stuck is considerably reduced.

Figure 2:
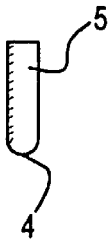
FIG. 2 is a cross-section along the longitudinal axis of the drop pin, of the part (5) of the drop pin that is situated above the yarn lead-through opening.

In a cross-section perpendicular to the plane of the drop pin (see FIG. 2) this supporting edge (4) moreover has also a spherical rounded form. Because of this the warp thread is not degraded by any sharp angle when led through the yarn lead-through opening (3) of this drop pin (1).

Figure 4:
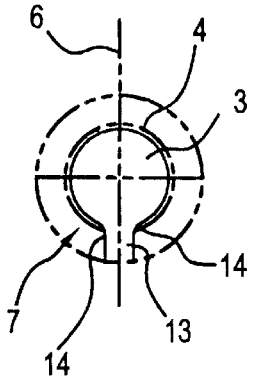
FIG. 4 represents the yarn lead-through opening (3) of a detailed representation of the drop pin of FIG. 1.

The transition zones (14) between the vertical edges of the slot (13) and the edge (7) of the yarn lead-through opening (3) have been rounded. This may clearly be seen in FIG. 4.

The parts (8), (9) of the body (2) extending at the left and right of the opening (3) are, in opposite directions, perpendicular to the plane of the drop pin (1), moved away from this plane. Owing to this an intermediate distance (15) between these parts (8), (9) is created in a direction perpendicular to the plane of the drop pin. This intermediate distance (15) is sufficiently long to allow a warp thread, extending in a direction perpendicular to the plane of the drop pin, to pass freely through the opening (3). This intermediate distance (15) and, because of this, the free passage in the plane of the drop pin (1), may clearly be seen in FIG. 3. The parts at a distance from each other (8), (9) are flat, extend in parallel planes and pass via curved transitional planes into the upper and lower parts of the body (2).

I claim:

1. Drop pin for a stop motion assembly comprising a body, a yarn lead-through opening disposed in the body for resting on a thread extending through the yarn lead-through opening, a supporting edge in the opening comprising a concavely curved border along the opening, wherein said supporting edge, in cross-section, is convex-shaped forming a rounded edge in the opening facilitating a smooth movement of the thread through the opening.

2. Drop pin according to claim 1, wherein the supporting surface forms an evenly curved bordering of the yarn lead-through opening.

3. Drop pin according to claim 1, wherein the supporting surface forms a circular bordering of the yarn lead-through opening.

4. Drop pin according to claim 1, wherein the supporting surface, in cross-section, has a spherical form.

5. Drop pin for a stop motion assembly comprising a body, a yarn lead-through opening provided in the body to rest on a thread extending through the opening, a supporting surface forming a concavely curved bordering of the opening, wherein said supporting surface, in cross-section, has a convex form with a number of angle forming sides.

6. Drop pin according to claim 1, wherein the edge bordering the yarn lead-through opening is carried out over at least along most of an entire length of the yarn lead-through opening as the supporting surface.

7. Drop pin according to claim 1, wherein parts of the drop pin for the stop motion assembly, bordering the yarn lead-through opening on both sides of a longitudinal axis of the drop pin, are at a distance from each other in a direction perpendicular to the plane of the drop pin, so that the thread extending through the yarn lead-through opening extends through the yarn lead-through opening in a same plane as a plane of the drop pin.

8. Device for detecting a thread breakage on a weaving machine comprising a number of drop pins for stop motion, disposed to be carried in a working position by a respective thread and to leave the working position on a thread breakage, detection means for detecting one or more drop pins having left the working position, and means to generate signals in response to a detection, wherein each drop pin is the drop pin of claim 1.

9. Weaving machine comprising the device for detecting a thread breakage of claim 8.

10. The device of claim 8, wherein the signals comprise warning signals.

11. The device of claim 10, wherein the signals comprise control signals.

12. The device of claim 8, wherein the signals comprise control signals.

13. Drop pin according to claim 5, wherein the number of angle forming sides form a polygon.

* * * * *